US009655406B2

(12) United States Patent
Cavaliere et al.

(10) Patent No.: US 9,655,406 B2
(45) Date of Patent: May 23, 2017

(54) ARTICLE OF FOOTWEAR HAVING AN ADJUSTABLE HEEL SYSTEM

(71) Applicant: NIKE, Inc., Beaverton, OR (US)

(72) Inventors: Sergio Cavaliere, Venice (IT); Giovanni Adami, Montebelluna TV (IT); Timothy J. Smith, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/449,699

(22) Filed: Aug. 1, 2014

(65) Prior Publication Data

US 2016/0029743 A1 Feb. 4, 2016

(51) Int. Cl.

| | |
|---|---|
| ***A43B 5/00*** | (2006.01) |
| ***A43B 7/14*** | (2006.01) |
| ***A43B 23/17*** | (2006.01) |
| ***A43B 21/24*** | (2006.01) |

(52) U.S. Cl.

CPC ..... *A43B 21/24* (2013.01); *A43B 5/00* (2013.01); *A43B 7/14* (2013.01); *A43B 23/17* (2013.01)

(58) Field of Classification Search

CPC ..... A43B 23/08; A43B 23/10; A43B 23/14; A43B 23/16; A43B 23/17; A43B 23/088; A43B 21/24; A43B 5/00; A43B 7/14; A43B 23/105; A43B 7/20; A43B 23/027; A43B 23/0275; A43B 23/0265; A43B 7/24

USPC ..... 36/58, 92, 105, 68, 69, 89, 88, 11

See application file for complete search history.

(56) References Cited

U.S. PATENT DOCUMENTS

| | | | | |
|---|---|---|---|---|
| 256,030 | A * | 4/1882 | Morton | A43B 23/16 36/68 |
| 912,579 | A * | 2/1909 | Kreoh | A43B 23/28 36/58.5 |
| 2,348,300 | A * | 5/1944 | Klaus | A43B 7/142 36/154 |
| 4,484,397 | A | 11/1984 | Curley, Jr. | |
| 4,638,576 | A | 1/1987 | Parracho et al. | |
| 5,425,184 | A * | 6/1995 | Lyden | A43B 21/28 36/114 |

(Continued)

FOREIGN PATENT DOCUMENTS

| | | |
|---|---|---|
| WO | 2014116617 A1 | 7/2014 |
| WO | 2016018494 A1 | 2/2016 |

OTHER PUBLICATIONS

International Search Report and Written Opinion for Application No. PCT/US2015/030887, mailed on Sep. 30, 2015, 11 pages.

*Primary Examiner* — Anna Kinsaul
*Assistant Examiner* — Griffin Hall
(74) *Attorney, Agent, or Firm* — Quinn IP Law

(57) ABSTRACT

An article of footwear having a heel system is disclosed. The heel system may include a medial heel member and a lateral heel member. The medial heel member and the lateral heel member may be disposed on a sole structure. The medial heel member may have a first rigidity and the lateral heel member may have a second rigidity that is different from the first rigidity. The difference in rigidity may provide different levels of support to a wearer's heel region. The medial heel member may extend from a medial edge of the sole structure to a rearward edge of the sole structure. The lateral heel member may extend from a lateral edge of the sole structure to the rearward edge of the sole structure.

11 Claims, 7 Drawing Sheets

(56) References Cited

U.S. PATENT DOCUMENTS 5,625,963 A * 5/1997 Miller ..... A43B 7/1495 36/114
5,896,683 A * 4/1999 Foxen ..... A43B 7/20 36/89
6,000,148 A * 12/1999 Cretinon ..... A43B 5/00 36/69
6,715,218 B2 4/2004 Johnson
7,082,702 B2 8/2006 Cretinon
7,866,063 B2 * 1/2011 Caine ..... A43B 13/026 36/114
8,020,317 B1 * 9/2011 Sokolowski ..... A43B 7/28 36/105
8,302,329 B2 * 11/2012 Hurd ..... A43B 23/08 36/68
8,327,560 B2 * 12/2012 Berend ..... A43B 7/142 36/132
8,677,656 B2 3/2014 Nishiwaki et al.
9,259,049 B2 * 2/2016 Adami ..... A43B 7/141
2004/0244226 A1 * 12/2004 Farys ..... A43B 5/003 36/140
2006/0248752 A1 11/2006 Kittner et al.
2007/0180730 A1 * 8/2007 Greene ..... A43B 9/00 36/3 A
2010/0293811 A1 11/2010 Truelsen
2011/0078922 A1 4/2011 Cavaliere et al.
2011/0185592 A1 * 8/2011 Nishiwaki ..... A43B 7/16 36/69
2011/0308109 A1 12/2011 Sokolowski
2012/0060395 A1 * 3/2012 Blevens ..... A43B 1/0072 36/30 R
2012/0198721 A1 * 8/2012 Cavaliere ..... A43B 7/14 36/42
2012/0255205 A1 * 10/2012 Jensen ..... A43B 1/0027 36/25 R
2012/0304491 A1 * 12/2012 Kimura ..... A43B 7/20 36/69
2014/0202044 A1 * 7/2014 Adami ..... A43B 7/141 36/34 R

* cited by examiner

ARTICLE OF FOOTWEAR HAVING AN ADJUSTABLE HEEL SYSTEM

BACKGROUND

The present embodiments relate generally to articles of footwear, and in particular to an adjustable heel system for an article of footwear.

Articles of footwear generally include two primary elements: an upper and a sole. The upper may be formed from a variety of materials that are stitched or adhesively bonded together to form a void within the footwear for comfortably and securely receiving a foot. The sole is secured to a lower portion of the upper and is generally positioned between the foot and the ground. In many articles of footwear, including athletic footwear styles, the sole often incorporates an insole, a midsole, and an outsole.

Some articles include heel systems that help to provide extra support at the heel of the foot. Heel systems can be integrated into an upper and/or attached to a sole.

SUMMARY

An article of footwear having a heel system is disclosed. The heel system may include a medial heel member and a lateral heel member. The medial heel member and the lateral heel member may be disposed on a sole structure. The medial heel member may have a first rigidity and the lateral heel member may have a second rigidity that is different from the first rigidity. The difference in rigidity may provide different levels of support to a wearer's heel region.

In one aspect, an article of footwear having a heel system is disclosed. The article of footwear may include a forefoot portion, a heel portion opposite the forefoot portion, a midfoot portion disposed between forefoot portion and heel portion, and a longitudinal axis extending between a medial side and a lateral side of the article of footwear. The article of footwear may further comprise a sole structure and an upper. The sole structure may have a ground-engaging surface and a foot side surface opposite the ground-engaging surface. The sole structure may further have a lateral edge extending along a lateral side of a perimeter of the sole structure, a medial edge extending along a medial side of the perimeter of the sole structure, and a rearward edge extending along a rearmost portion of the perimeter of sole structure. The upper may be connected to the sole structure. The heel system may have a medial heel member that is an elongate arm extending from the medial side of the sole structure and a lateral heel member that is an elongate arm extending from the lateral side of the sole structure. The medial heel member and the lateral heel member may be designed to together cradle the heel of a wearer.

The medial heel member may be shaped as a mirror image of the lateral heel member.

The medial heel member may extend from the rearward edge of the sole structure to the medial edge of the sole structure.

The lateral heel member may extend from the rearward edge of the sole structure to the lateral edge of the sole structure.

The lateral heel member may have a first rigidity and the medial heel member may have a second rigidity that is different from the first rigidity.

The lateral heel member may be made of a first material and the medial heel member may be made of a second material that is different from the first material.

In one aspect, an article of footwear having a heel system is disclosed. The article of footwear may include a forefoot portion, a heel portion opposite the forefoot portion, a midfoot portion disposed between forefoot portion and heel portion, and a longitudinal axis extending between a medial side and a lateral side of the article of footwear. The article of footwear may further comprise a sole structure and an upper. The sole structure may have a ground-engaging surface and a foot side surface opposite the ground-engaging surface. The sole structure may further have a lateral edge extending along a lateral side of a perimeter of the sole structure, a medial edge extending along a medial side of the perimeter of the sole structure, and a rearward edge extending along a rearmost portion of the perimeter of sole structure. The upper may be connected to the sole structure.

The heel system may have a medial heel member extending from the medial side of the sole structure and a lateral heel member extending from the lateral side of the sole structure. The lateral heel member may have a first rigidity and the medial heel member may have a second rigidity that is different from the first rigidity.

The lateral heel member may be made of a first material and the medial heel member may be made of a second material that has a different rigidity from the first material.

The lateral heel portion may be more rigid than the medial heel portion.

The medial heel member may extend from the rearward edge of the sole structure to the medial edge of the sole structure.

The lateral heel member may extend from the rearward edge of the sole structure to the lateral edge of the sole structure.

The lateral heel member may be shaped as a mirror image of the medial heel member.

The lateral heel member and the medial heel member may both be disposed inwardly of the upper.

In one aspect, an article of footwear having a heel system is disclosed. The article of footwear may include a forefoot portion, a heel portion opposite the forefoot portion, a midfoot portion disposed between forefoot portion and heel portion, and a longitudinal axis extending between a medial side and a lateral side of the article of footwear. The article of footwear may further comprise a sole structure and an upper. The sole structure may have a ground-engaging surface and a foot side surface opposite the ground-engaging surface. The sole structure may further have a lateral edge extending along a lateral side of a perimeter of the sole structure, a medial edge extending along a medial side of the perimeter of the sole structure, and a rearward edge extending along a rearmost portion of the perimeter of sole structure. The upper may be connected to the sole structure.

The heel system may have a medial heel member and a lateral heel member. The medial heel member may be an elongate arm having a first medial end and a second medial end opposite the first medial end. The first medial end of the medial heel member may be connected to the medial edge of the sole structure and the second medial end of the medial heel member may be connected to the rearward edge of the sole structure. The lateral heel member may be an elongate arm having a first lateral end and a second lateral end opposite the first lateral end. The first lateral end of the lateral heel member may be connected to the lateral edge of the sole structure and the second lateral end of the lateral heel member may be connected to the rearward edge of the sole structure.

The sole structure may have a first medial slot disposed on a medial edge of the sole structure and the first medial end of the medial heel member may have a tab that is sized and shaped to fit within the first medial slot.

The sole structure may have a second medial slot disposed on a rearward edge of the sole structure and the second medial end of the medial heel member may have a tab that is sized and shaped to fit within the second medial slot. The medial heel member may extend from the first lateral slot to the second lateral slot.

The sole structure may have a first lateral slot disposed on a lateral edge of the sole structure and the first lateral end of the lateral heel member may have a tab that is sized and shaped to fit within the first lateral slot.

The sole structure may have a second lateral slot disposed on a rearward edge of the sole structure and the second medial end of the lateral heel member may have a tab that is sized and shaped to fit within the second lateral slot. The lateral heel member may extend from the first lateral slot to the second lateral slot.

The lateral heel member may have a first rigidity and the medial heel member may have a second rigidity that is different from the first rigidity.

The lateral heel member and the medial heel member may both follow the contour of the upper and may be designed to together wrap around and cradle the heel region of a wearer.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
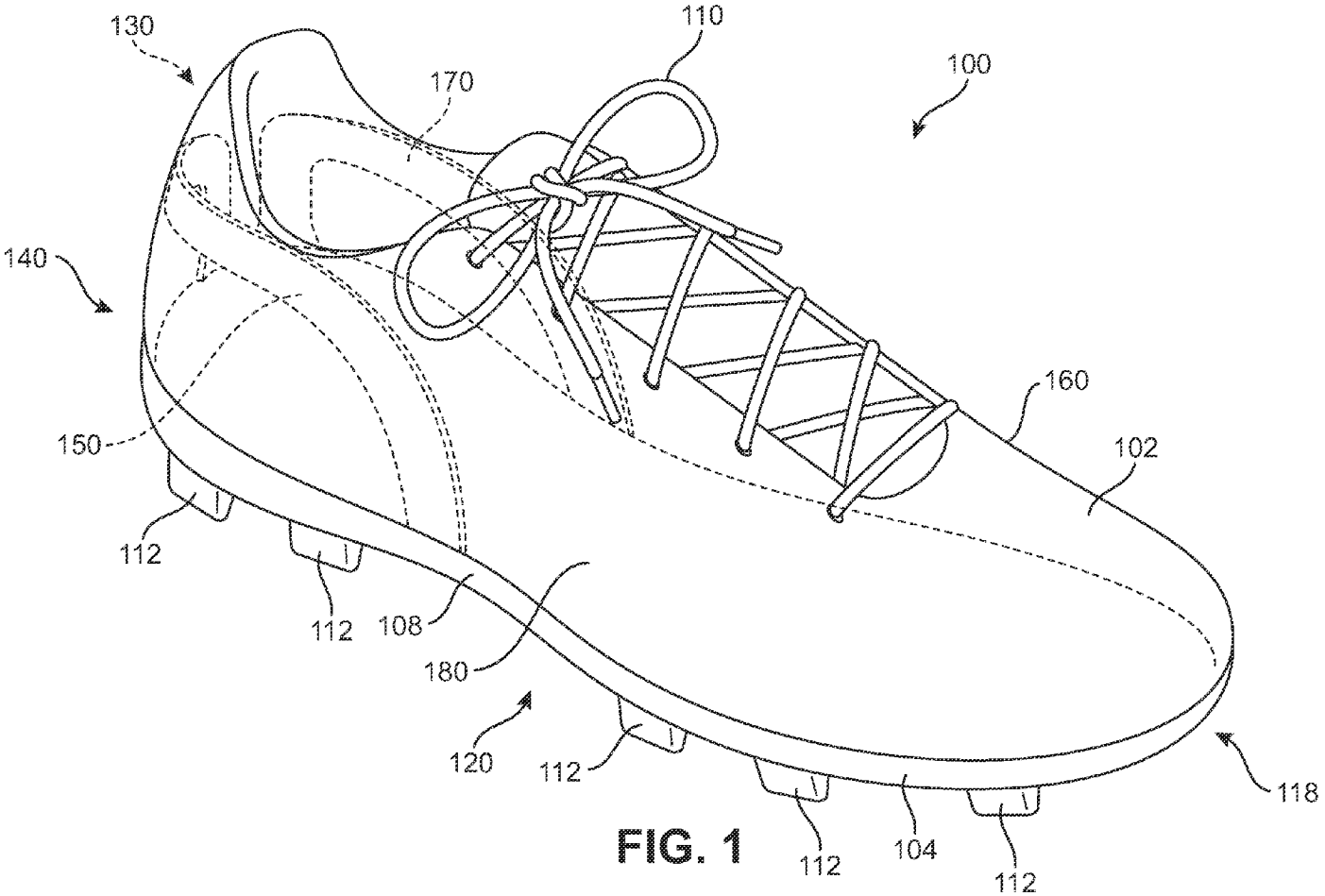
FIG. 1 is an isometric front view of an exemplary embodiment of an article of footwear with a heel system.

An article of footwear having an adjustable heel system is disclosed. The heel system may provide an adjustable level of support to a heel region of a wearer's foot during physical activity. The article of footwear may include an upper and a sole structure. For example, as shown in FIG. 1, an article of footwear 100 may include an upper 102 and a sole structure 104. The heel system may be connected to the upper and/or the sole structure. For example, FIG. 1 shows an embodiment in which article of footwear 100 may include a heel system 130 connected to sole structure 104.

For clarity, the following detailed description discusses an exemplary embodiment, in the form of a soccer shoe, but it should be noted that the present embodiments could take the form of any article of footwear including, but not limited to: hiking boots, football shoes, sneakers, rugby shoes, basketball shoes, baseball shoes as well as other kinds of shoes. In the embodiments shown in the figures, article of footwear 100, also referred to simply as article 100, is intended to be used with a right foot; however, it should be understood that the following discussion may equally apply to a mirror image of article of footwear 100 that is intended for use with a left foot.

For consistency and convenience, directional adjectives are employed throughout this detailed description corresponding to the illustrated embodiments. The term "longitudinal" as used throughout this detailed description and in the claims refers to a direction extending along a length of a component, such as upper 102 or sole structure 104. Also, the term "lateral" as used throughout this detailed description and in the claims refers to a direction extending a width of a component. In other words, the lateral direction may extend between a medial side and a lateral side of a component in a direction that is perpendicular to the longitudinal direction. Furthermore, the term "vertical" as used throughout this detailed description and in the claims refers to a direction generally perpendicular to a lateral and longitudinal directions. For example, in cases where article 100 is planted flat on a ground surface, the vertical direction may extend from the ground surface upward. It will be understood that each of these directional adjectives may be applied to individual components of an article, such as an upper, sole structure, and/or a heel system as well as to sub-components of an upper, sole structure, and/or heel component.

For purposes of reference, article 100 may be divided into forefoot portion 118, midfoot portion 120, and heel portion 140. Forefoot portion 118 may be generally associated with the toes and joints connecting the metatarsals with the phalanges. Midfoot portion 120 may be generally associated with the arch of a foot. Likewise, heel portion 140 may be generally associated with the heel of a foot, including the calcaneus bone. It will be understood that forefoot portion 118, midfoot portion 12, and heel portion 140 are only intended for purposes of description and are not intended to demarcate precise regions of article 100. In addition, article 100 may include lateral side 180 and medial side 160. In particular, lateral side 180 and medial side 160 may be opposing sides of article 100. Furthermore, both lateral side 180 and medial side 160 may extend through forefoot portion 118, midfoot portion 12, and heel portion 140. A longitudinal axis may extend through the length of article of footwear 100 through forefoot portion 118, midfoot portion 120, and heel portion 140. The longitudinal axis may divide article of footwear into lateral side 180 and medial side 160.

Sole structure may include a ground-engaging surface 400 and a foot side surface 200 that is opposite ground-engaging surface 400. The sole structure may be used to attenuate ground reaction forces when compressed between the foot and the ground during walking, running, or other ambulatory activities. Additionally, the sole structure may provide grip on a ground-engaging surface. For example, in some embodiments, as shown in FIGS. 1-6, sole structure 104 may include a set of cleats 112 extending from ground-engaging surface 400. In another example, in other embodiments, the sole structure may include a ground-engaging surface comprising a textured surface that provides grip. In different embodiments, a sole structure may include different components. For example, a sole structure may include an outsole, a midsole, and/or an insole. In some cases, one or more of these components may be optional.

Generally, upper 102 may be any type of upper. In particular, upper 102 may have any design, shape, size and/or color. For example, in embodiments where article 100 is a basketball shoe, upper 102 could be a high top upper that is shaped to provide high support on an ankle. In embodiments where article 100 is a soccer shoe, as shown in FIG. 1, upper 102 could be a low top upper.

Upper 102 can include provisions for fastening article 100 to a foot. For example, upper 102 may include fastening system 110. In some cases, fastening system 110 comprises a shoe lace that can be used to close an opening, which is configured to receive a foot. However, it will be understood that the type of fastening system could vary in different embodiments and may be selected according to factors including ease of use and comfort.

The upper may be connected to the sole structure by any suitable mechanism. For example, in some embodiments, upper 102 may be connected sole structure 104 by stitching, adhesive, and/or ultra-sonic welding. The type of mechanism may be selected based on a variety of factors. For example, in some embodiments, the type of mechanism may be selected based upon the type of materials the upper and sole structure are made of and/or the type of sport the article of footwear is meant for.

Figure 2:
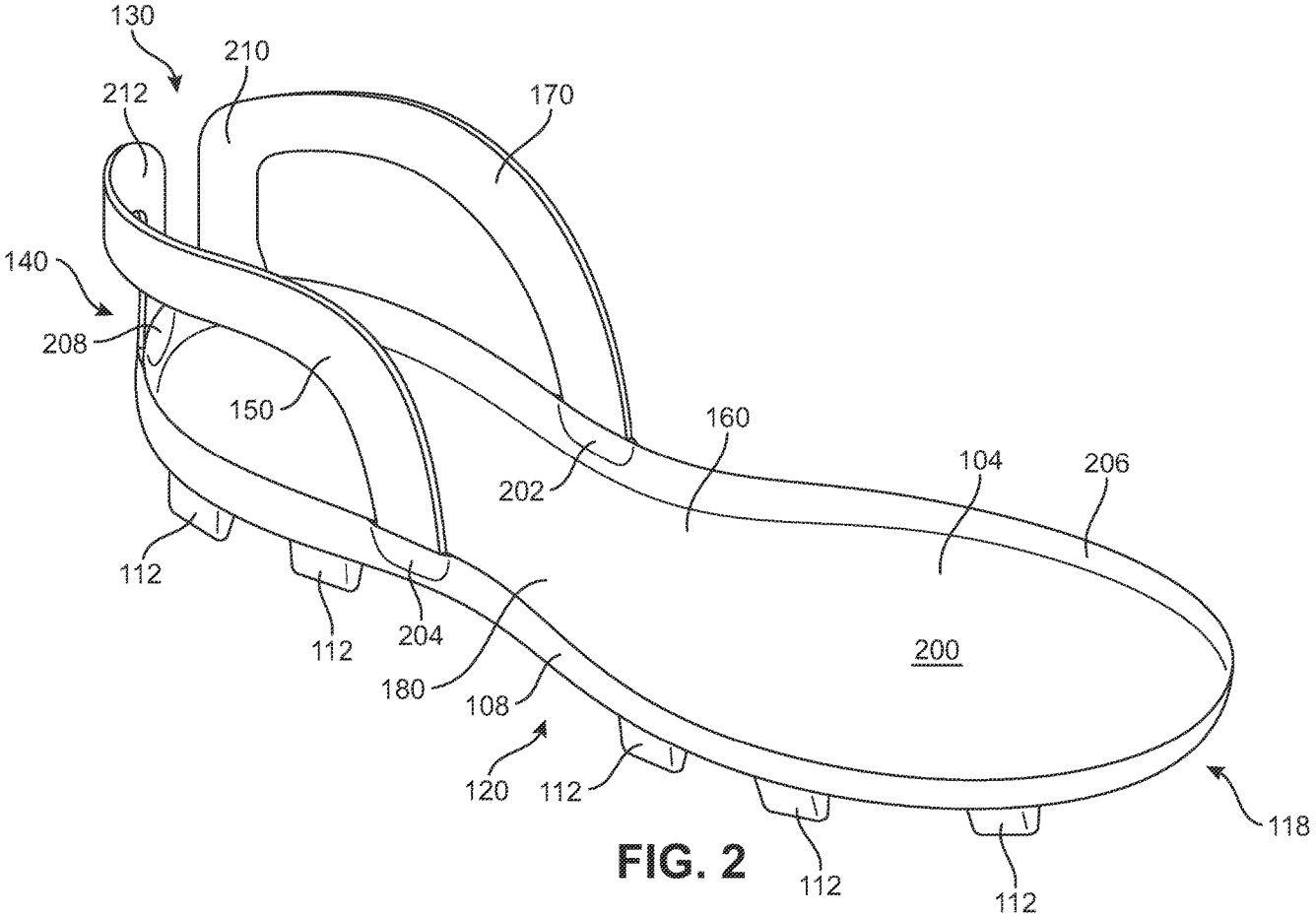
FIG. 2 is an isometric front view of the sole structure and heel system of FIG. 1 from a lateral side.
Figure 3:
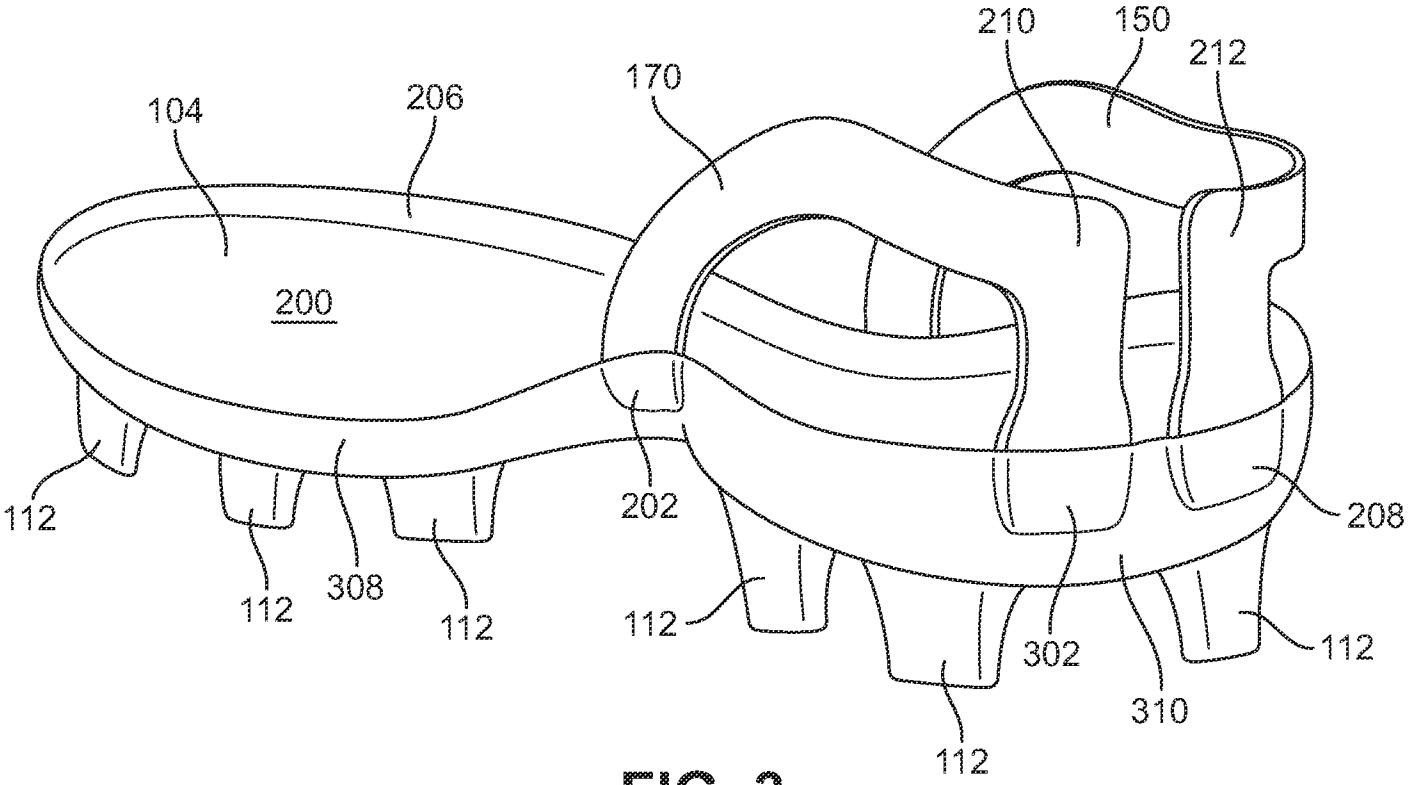
FIG. 3 is an isometric rear view of the sole structure and heel system of FIG. 1 from a medial side.

Sole structure 104 may have a lateral edge 108 extending along a lateral side of a perimeter of sole structure 104. Sole structure 104 may have a medial edge 308 extending along a medial side of the perimeter of sole structure 104. Sole structure 104 may have a rearward edge 310 extending along a rearmost portion of the perimeter of sole structure 104. In some embodiments, the sole structure may have a rim. For example, as shown in FIGS. 1-6, sole structure 104 may have a rim 206 extending along the perimeter of sole structure 104. In some embodiments, rim 206 may extend along rearward edge 310. In another example, rim 206 may extend along lateral edge 108. In yet another example, rim 206 may extend along medial edge 308. In some embodiments, as shown in FIGS. 2-3, rim 206 may extend continuously along the periphery of sole structure 104. In some embodiments, sole structure 104 may not have a rim.

Figure 4:
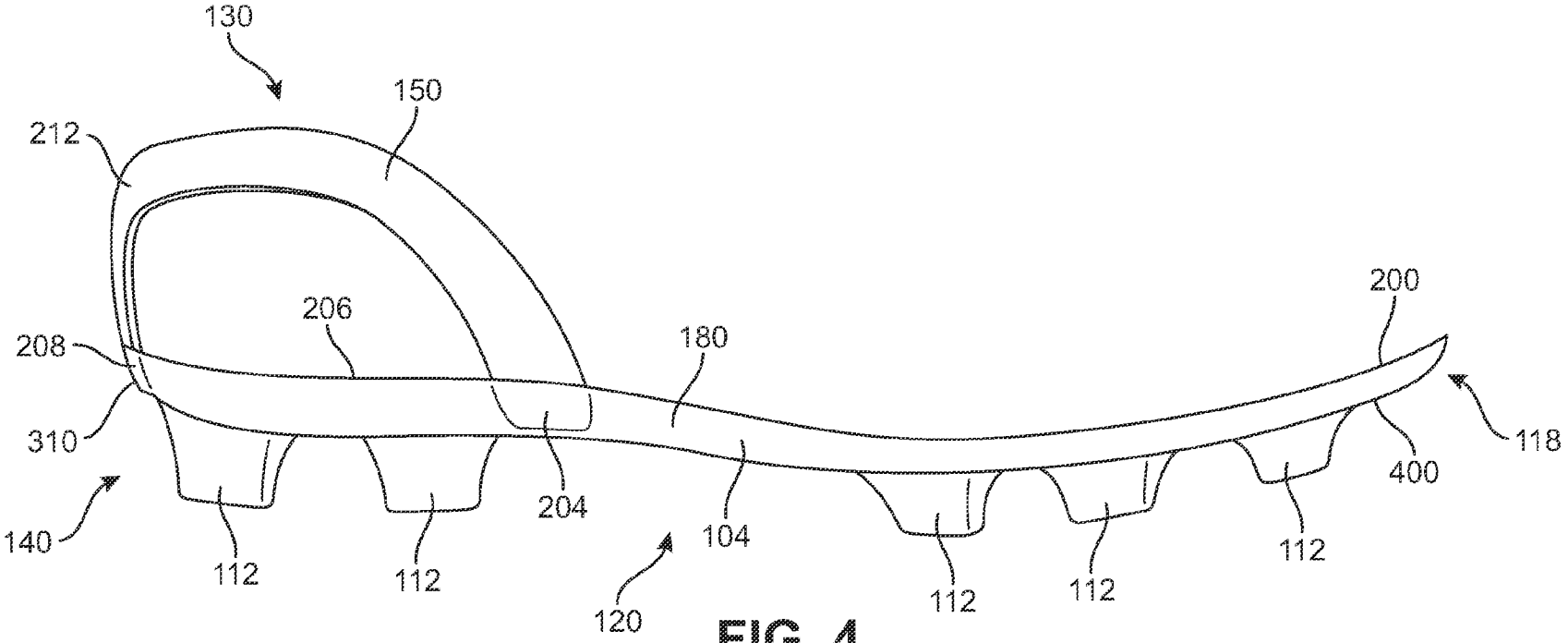
FIG. 4 is a side view of the sole structure and heel system of FIG. 1 from a lateral side.
Figure 5:
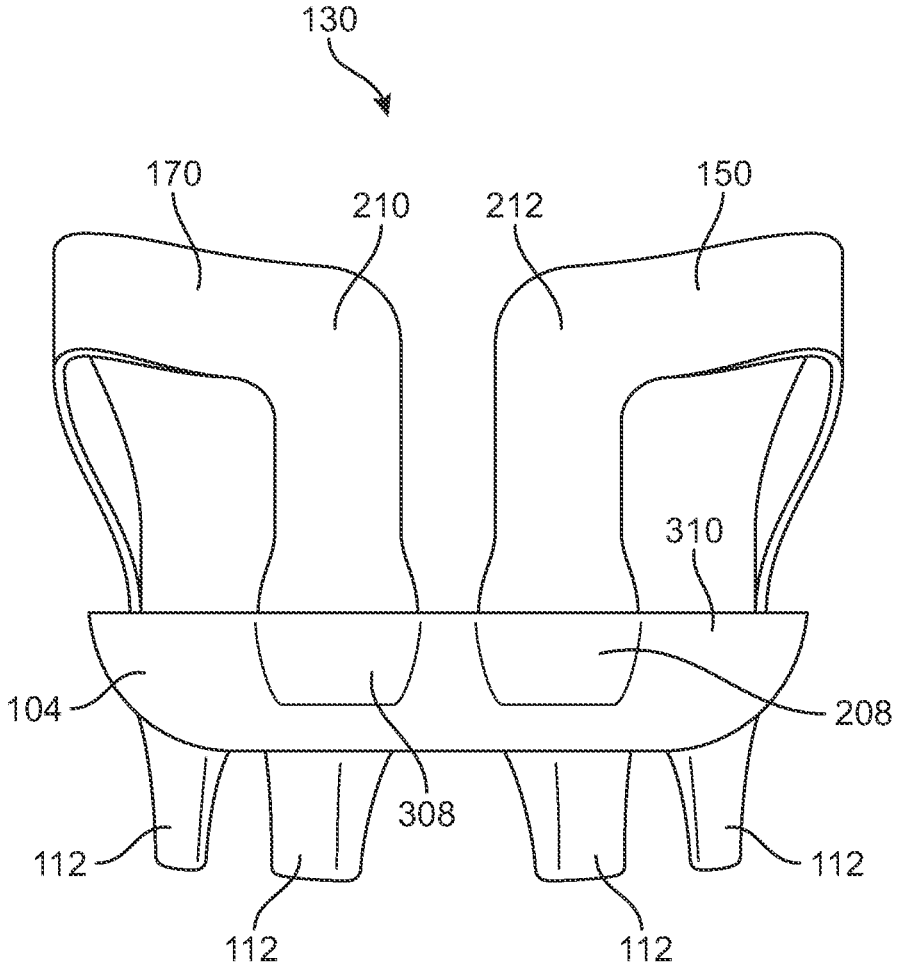
FIG. 5 is a rear view of the sole structure and heel system of FIG. 1.
Figure 6:
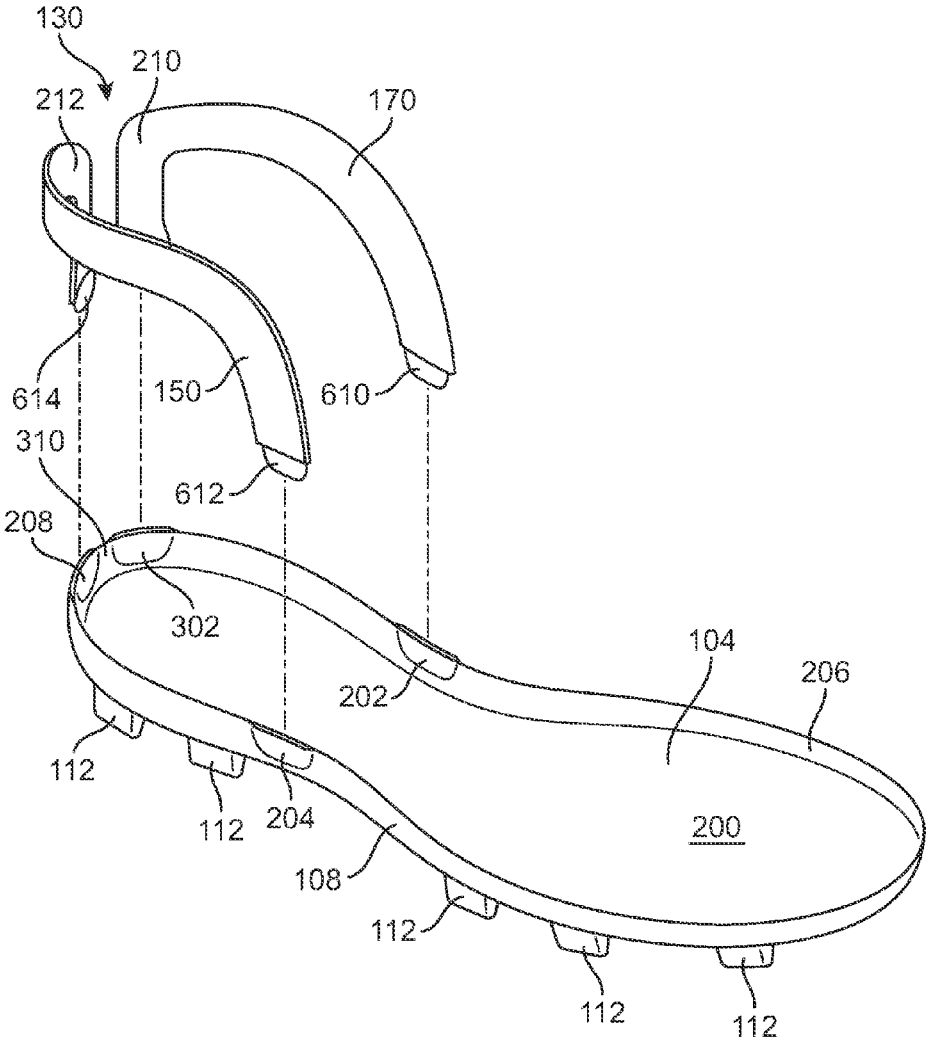
FIG. 6 is an exploded view of the sole structure and heel system of FIG. 1.
Figure 7:
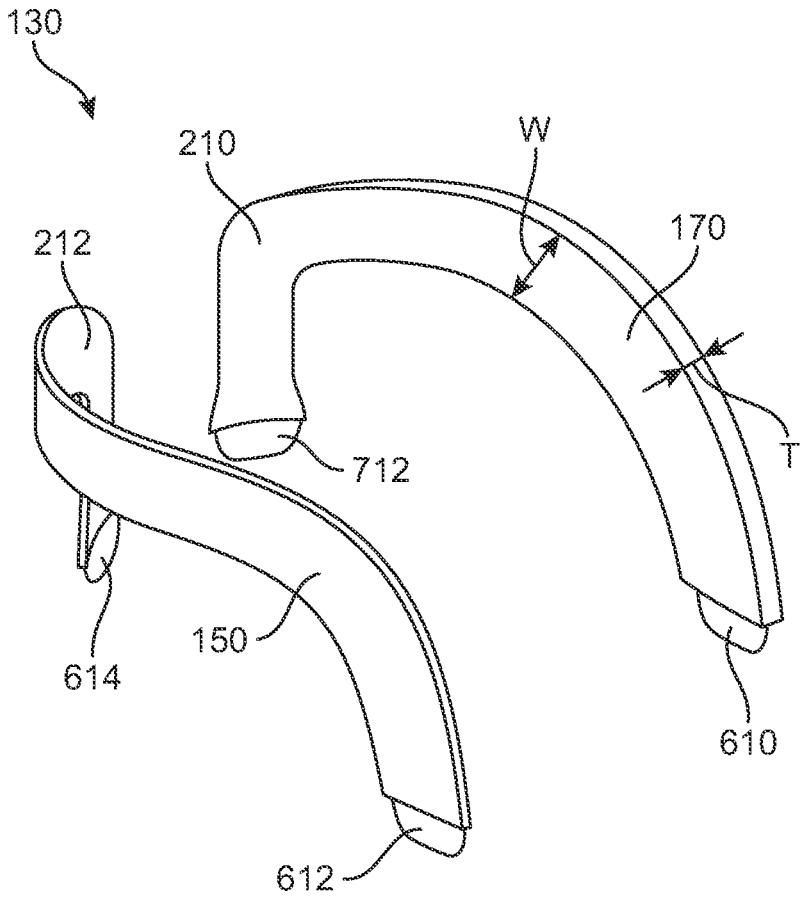
FIG. 7 is an isolated view of the heel system.

The heel system may include a lateral heel member and a medial heel member. For example, as shown in FIGS. 1-7, heel system 130 may include a lateral heel member 150 and a medial heel member 170. The lateral heel member may be an elongate arm. For example, as best shown in FIGS. 6 and 7, lateral heel member 150 may be an elongate arm extending from a first lateral end 612 to a second lateral end 614. First lateral end 612 and second lateral end 614 may be terminal ends. First lateral end 612 may be a forward lateral end. Second lateral end 614 may be a rearward lateral end. The medial heel member may be an elongate arm. For example, as best shown in FIG. 7, medial heel member 170 may be an elongate arm extending from a first medial end 610 to a second medial end 712. First medial end 610 and second medial end 712 may be terminal ends. First medial end 610 may be a forward medial end. Second medial end 712 may be a rearward medial end.

As indicated in FIG. 7, medial heel member 170 may have a thickness T, a width W, and a length that is perpendicular to both the thickness and the width. Lateral heel member 170 may have a thickness, a width, and a length that is perpendicular to both the thickness and the width.

In some embodiments, the lateral heel member and medial heel member may both have an inner surface facing an interior of the article of footwear. The inner surfaces of the lateral heel member and the medial heel member may cradle the heel region of the wearer's foot.

In some embodiments, the lateral heel member may have a first segment disposed between the second lateral end and a point. For example, as best shown in FIGS. 3, 5, and 7, lateral heel member 150 may have a segment disposed between second lateral end 614 and a point 212. The first segment may be substantially straight. The term "substantially straight" is used to mean that the segment is more straight than curved. The first segment of the lateral heel member may be designed to lie against and support the rearward region of a wearer's heel adjacent the wearer's Achilles tendon. Thus, while the shown embodiment includes first segment of the lateral heel member that extends in a straight line and has straight, parallel sides (defining the width) and supports the rearward region of the wearer's heel, it is understood that, in some embodiments, this segment may have any shape that supports the rearward region of a wearer's heel adjacent the wearer's Achilles tendon. For example, the first segment may be slightly curved or may further include curved or undulating sides, jagged sides made of straight segments at various angles, or have fanciful edging.

In some embodiments, the lateral heel member may have a second segment. For example, as shown in FIGS. 2-4, lateral heel segment 150 have a second segment extending between point 212 and first lateral end 612. As shown in FIGS. 1-7, in some embodiments, the first segment and the second segment of the lateral heel member may together form a unitary, one-piece structure. In other embodiments, the first segment and the second segment of the lateral heel member may include individual pieces attached together at point 212.

As shown in FIGS. 2-4, the second segment of lateral heel member 150 may generally extend parallel to sole structure 104 in a substantially straight line for a distance before curving downwardly toward sole structure 104. This path of the second segment may provide support to the lateral side of the wearer's heel. The second segment of the lateral heel member 150 may generally extend parallel to sole structure 104 in a substantially straight line passing below the lateral malleolus of the wearer's ankle. As shown in FIG. 1, the second segment of lateral heel member 150 may generally extend parallel to sole structure 104 in a substantially straight line that is level with or slightly below a topline of the upper 102 that defines an opening of the upper where the foot is inserted. The second segment of lateral heel member 150 may generally extend parallel to sole structure 104 in a substantially straight line before curving downward to sole structure 104 at a point where, as described in more detail below, lateral heel member 150 may be connected to sole structure 104.

The second segment of the lateral heel member may be designed to lie against and support the lateral side of a wearer's heel. Thus, while the shown embodiment includes a first segment having parallel sides (defining the width) and supporting the lateral region of the wearer's heel, it is understood that, in some embodiments, this segment may have any shape that supports the lateral side of a wearer's heel region. For example, the second segment of the lateral heel member may more curved or may further include undulating sides, jagged sides made of straight segments at various angles, or have fanciful edging.

In some embodiments, similar to the lateral heel member, the medial heel member may have a first segment disposed between the second medial end and a point. For example, as best shown in FIGS. 3, 5, and 7, medial heel member 170 may have a first segment disposed between second medial end 712 and a point 210. Similar to the first segment of the lateral heel member, the first segment of the medial heel member may be designed to lie against and support the rearward portion of a wearer's heel adjacent the wearer's Achilles tendon. Similar to the first segment of the lateral heel member, the first segment of the medial heel member may be substantially straight. In some embodiments, the first segment of the medial heel member may be substantially parallel to the first segment of the lateral heel member. For example, as shown in FIGS. 3, 5, and 7, the first segment of the medial heel member may be parallel to the first segment of the lateral heel member. The first segment of the medial heel member and the first segment of the lateral heel member may together cradle a rearward surface of the wearer's heel region.

In some embodiments, similar to the lateral heel member, the medial heel member may have a second segment. For example, as shown in FIGS. 2-4, medial heel segment 170 may have a second segment extending between point 210 and first medial end 610. As shown in FIGS. 1-7, in some embodiments, the first segment and the second segment of the medial heel member may together form a unitary, one-piece structure. In other embodiments, the first segment and the second segment of the medial heel member may include individual pieces attached together at point 210.

As shown in FIGS. 2-4, the second segment of medial heel member 170 may generally extend parallel to sole structure 104 in a substantially straight line for a distance before curving downwardly toward sole structure 104. This path of the second segment may provide support to the medial side of the wearer's heel. The second segment of medial heel member 170 may generally extend parallel to sole structure 104 in a substantially straight line passing below the lateral malleolus of the wearer's ankle. As shown in FIG. 1, the second segment of medial heel member 170 may generally extend parallel to sole structure 104 in a substantially straight line that is level with or slightly below the topline of the upper 102 that defines an opening of the upper where the foot is inserted. The second segment of medial heel member 170 may generally extend parallel to sole structure 104 in a substantially straight line before curving downward to sole structure 104 at a point where, as described in more detail below, medial heel member 170 may be connected to sole structure 104.

The second segment of the medial heel member may be designed to lie against and support the medial side of a wearer's heel. Thus, while the shown embodiment includes a first segment having parallel sides (defining the width) and supporting the medial region of the wearer's heel, it is understood that, in some embodiments, this segment may have any shape that supports the medial side of a wearer's heel region. For example, the second segment of the medial heel member may be more curved or may further include undulating sides, jagged sides made of straight segments at various angles, or have fanciful edging. In some embodiments, for example, as shown in FIGS. 3, 5, and 7, the second segment of the medial heel member may be parallel to the second segment of the lateral heel member. The second segment of the medial heel member and the first segment of the lateral heel member may together cradle a rearward surface of the wearer's heel region. The second segment of the medial heel member and the first segment of the lateral heel member may be designed to wrap around the wearer's heel region from the sides to the rear of the wearer's heel region. In some embodiments, the medial heel member and the lateral heel member may be designed to follow the contour of the upper. For example, as shown in FIG. 1, the heel members may follow the contour of the inner surface of upper 102.

In some embodiments, one or both of the medial heel member and the lateral heel member may have a flat outer surface facing away from the interior of the article of footwear. In some embodiments, one or both of the medial heel member and the lateral heel member may have a flat inner surface facing toward the interior of the article of footwear. In some embodiments, as shown in FIGS. 1-7, one or both of the lateral heel member and the medial heel member may have both a flat inner surface and a flat outer surface. In some embodiments, one or both of the medial heel member and the lateral heel member have a contoured outer surface. For example, the outer surface may be rounded. In some embodiments, one or both of the medial heel member and the lateral heel member have a contoured inner surface. For example, the inner surface may be rounded.

In some embodiments, the lateral heel member of the heel system may have a shape that differs substantially from the shape of the medial heel member. In other embodiments, for example, as shown in FIGS. 1-7, lateral heel member 150 may be shaped as a mirror image of medial heel member 170 and may be parallel with medial heel member 170.

In different embodiments, the material composition of heel system 130 could vary. Some examples of different materials that may be used include, but are not limited to: plastics (including polyurethane plastics and thermoplastic polyurethane plastics), foam materials, metallic materials, composite materials (such as carbon-fiber composite materials, glass-fiber composite materials and other composite materials) as well as any other materials known in the art for use in making heel systems, heel counters, heel cups or similar structures. Some embodiments may comprise a heel system that is substantially monolithic, so that all portions of the heel system have a substantially similar material composition. In other embodiments, however, some portions of a heel system could be made of different materials from other portions of the heel system. As one possible example, some embodiments can use different materials for constructing the medial heel portion and the lateral heel portion of the heel system. Such a variation in materials could provide different material characteristics for the different portions and could be used, for example, to modify the rigidity characteristics of the lateral heel portion relative to the medial heel portion (or vice versa). The type of materials used for a heel system may be selected according various factors including, but not limited to, desired weight, desired rigidity, desired durability, desired abrasion resistance, desired resiliency, molding or other manufacturing considerations as well as possibly other factors.

The various features of a heel system may be selected to provide a customized level of support. In order to provide different amounts and/or types of support on a lateral side and medial side of the heel, heel system 130 may be configured with different structural features along the lateral and medial members of heel system 130. For example, the lateral heel member may have a first rigidity and the medial heel member may be designed to have a second rigidity that is different from the first rigidity. This difference in rigidity may be accomplished by making each heel member out of different materials. For example, the lateral heel member may be made out of a first material having a first rigidity and the medial heel member may be made out of a second material having a second rigidity that is different from the first rigidity. In particular, in some embodiments, the first material may be a first type of polyurethane plastic and the second material may be a second type of polyurethane polymer having more flexibility or more rigidity than the first type of polyurethane plastic.

In some embodiments, instead of or in addition to using different materials, a difference in rigidity between the lateral heel member and the medial heel member may also be accomplished by adjusting the size and/or shape of the heel members. For example, one heel member may be thicker, and, therefore, more rigid than the other heel member. The thickness of the heel members may be adjusted to tune the level of support provided by the members.

In some embodiments, to adjust the rigidity, one heel member may be swapped out for another heel member having a different rigidity. For example, a first lateral heel member may be swapped out for a second lateral heel member that is more rigid than the first lateral heel member. In some embodiments, the width of the medial heel member and/or the lateral heel member may vary along its length. For example, the width of the lateral heel member may narrow at a point where less rigidity is desired. In some embodiments, as in the shown embodiments, the width of the medial heel member and/or the lateral heel member may be continuous along their length. In some embodiments, the length of the first segment of the lateral heel member may be different from the length of the first segment of the medial heel member. Such a difference in length may be made to impart more rigidity or more flexibility to one of the heel members.

Generally, the heel system may be associated with one or more components of the article of footwear. For example, in some embodiments, heel system 130 may be associated with upper 102. In some cases, heel system 130 could be an external heel system that is disposed outside of upper 102 and generally visible on article 100. As one example, heel system 130 may be disposed on an outer surface of upper 102, such that heel system 130 cradles heel portion 140 of upper 102. In other embodiments, as shown in FIG. 1, heel system 130 could be an internal heel system that is disposed within at least one layer of upper 102 and therefore not generally visible. In one embodiment, heel system 130 could be disposed inwardly of the innermost layer of upper 102, so that heel system 130 directly contacts a foot inserted into article 100. In another embodiment, heel system 130 could be integrated into a portion of upper 102, such that heel system 130 is disposed between two different layers of upper 102.

In some embodiments, the heel system may be associated with the sole structure. For example, as shown in FIGS. 1-6, heel system 130 may be connected to sole structure 104. Heel system 130 could be attached to one or more components of article 100 using a variety of mechanisms. In some embodiments, heel system 130 could be stitched to a component (such as upper 102 or sole structure 104). As shown in FIGS. 1-7 and explained in more detail below, the heel system may be attached to the sole structure by a tab and slot system. In other embodiments, the heel system may be additionally or alternatively attached to the sole structure adhesive. For example, the heel system may be bonded to the sole structure by cement for plastics. In some embodiments, the heel system and sole structure may be bonded to each other such that the heel system and sole structure are fused together. For example, the tabs and slots may be heated to soften and may be fused together. In another example, the heel system may be fused to the sole structure by ultra-sonic welding. Using an adhesive alone without stitching or fusing parts together without stitching may reduce the weight of the article of footwear.

FIGS. 1-7 show an example of an embodiment in which the heel system may be attached to the sole structure by a tab and slot system. As best shown in FIGS. 6 and 7, first lateral end 612, second lateral end 614, first medial end 610, and second medial end 712 may include tabs. In some embodiments, as shown in FIGS. 6 and 7, the tabs may be thinner and narrower than the remainder of the heel members. For example, as in the shown embodiment, the thickness T of medial heel member 170 may thin at the tabs. As in the shown embodiment, the width W of medial heel member 170 may narrow at the tabs. In some embodiments, the tabs may have a tapered width and/or thickness. In some embodiments, the tabs may have the same width and/or thickness as the remainder of the heel members.

The sole structure may include slots into which the tabs may fit. For example, as shown in FIG. 6, sole structure 104 may include first medial slot 202, second medial slot 302, first lateral slot 204, and second lateral slot 208. The tab disposed on first medial end 610 may be sized and shaped to fit within first medial slot 202. In other words, the tab disposed on first medial end 610 may have a size and shape corresponding with a size and shape of first medial slot 202.

The tab disposed on second medial end 712 may be sized and shaped to fit within second medial slot 302. In other words, the tab disposed on second medial end 712 may have a size and shape corresponding with a size and shape of second medial slot 302.

The tab disposed on first lateral end 612 may be sized and shaped to fit within first lateral slot 204. In other words, the tab disposed on first lateral end 612 may have a size and shape corresponding with a size and shape of first lateral slot 204.

The tab disposed on second lateral end 614 may be sized and shaped to fit within second lateral slot 208. In other words, the tab disposed on second lateral end 614 may have a size and shape corresponding with a size and shape of second lateral slot 208.

The location of the slots of the sole structure may be selected based on a variety of factors. For example, the location of the slots of the sole structure may be selected based on the size of the heel members and/or by the type of support that is to be provided by the heel members. In some embodiments, the first medial slot may be disposed on the medial side of the sole structure in a position that is between the midfoot portion and the rearward edge. This position may be closer to the midfoot portion than the rearward edge. In some embodiments, as shown in FIGS. 4 and 6, first medial slot 202 may be disposed on medial edge 308. First medial slot 202 is shown as being disposed within rim 206. Second medial slot 302 may be disposed on medial side 160 on rearward edge 310.

In some embodiments, the first lateral slot may be disposed on the lateral side of the sole structure in a position that is between the midfoot portion and the rearward edge. This position may be closer to the midfoot portion than the rearward edge. In some embodiments, as shown in FIGS. 4 and 6, first lateral slot 204 may be disposed on lateral edge 108. First lateral slot 204 is shown as being disposed within rim 206. Second lateral slot 208 may be disposed on lateral side 180 on rearward edge 310.

The position of the slots may vary. For example, in some embodiments, the slots on the medial side may be positioned closer together or further from one another. In such embodiments, the medial heel members may be shorter or longer, respectively. Similarly, in some embodiments, the slots on the lateral side may be positioned closer together or further from one another. In such embodiments, the lateral heel members may be shorter or longer, respectively. In some embodiments, one or more of the slots may be disposed inwardly from rim 206. In yet other embodiments, instead of slots, cut-outs may be provided on an inner surface or an exterior surface of the rim. The tabs on the heel members may fit within the cut-outs.

A heel system can include provisions for providing differential support on the lateral and medial sides of the heel. In some embodiments, for example, the geometry and/or curvature of the lateral heel portion and the medial heel portion of the heel system could be varied to provide different amounts and/or types of support to the lateral and medial sides of the foot. In some embodiments, the overall shape of the lateral heel portion and the medial heel portion may be substantially different, to provide different amounts and/or types of support on opposing sides of the heel. In some embodiments, one or more dimensions of the lateral heel portion and the medial heel portion could be substantially different, to provide different amounts and/or types of support on opposing sides of the heel. In some embodiments, the materials used for the lateral heel portion and the medial heel portion could be substantially different, to provide different amounts and/or types of support on opposing sides of the heel.

In some embodiments, in addition to having 4 slots along rim 206, the sole structure may have additional slots along rim 206 such that the position of the heel members may be adjusted. For example, sole structure 104 may have an additional slot disposed next to first medial slot 202 in a position that is closer to rearward edge 310 than the position of first medial slot 202. In such an embodiment, medial heel member 170 may be swapped out for a shorter medial heel member. The shorter medial member may have tabs that are inserted into second medial slot 302 and the additional slot that is disposed next to first medial slot 202. A plurality of slots may be provided on sole structure 104 to provide a variety of positions in which the heel members may be attached to sole structure.

In some embodiments, differences in geometry, height and/or material composition between lateral heel portion 150 and medial heel portion 170 may contribute to different characteristics, such as different degrees of flexibility and bending. However, the different bending characteristics of lateral heel portion 150 and medial heel portion 170 may result in substantially different amounts of bending. In particular, lateral heel portion 150 may undergo substantially less bending than medial heel portion 170, as lateral heel portion 150 may generally have a geometry that imparts a greater rigidity than medial heel portion 170. In contrast, medial heel portion 170 may generally have a geometry that imparts a greater degree of flexibility than lateral heel portion 150. Thus, medial heel portion 170 may undergo substantially more bending or displacement from a default (or unstressed) position when compared with lateral heel portion 150. In other words, medial heel portion 170 may provide more give and may give more flexible or variable support. Lateral heel portion 150 may instead provide increased strength and limited bending or displacement from a default (or unstressed) position. Using this configuration, heel system 130 may present a relatively rigid lateral sidewall that helps reduce in-shoe slip during lateral motions, while increasing flexibility on the medial side to enhance turning and cutting. This feature may be apparent when an athlete wearing the article of footwear makes a cutting motion, for example, while dribbling a soccer ball. Lateral heel portion 150 may remain relatively stiff to provide lateral support to the foot during planting. As an athlete wearing the article of footwear makes a cutting motion, medial heel portion 170 may bend and adapt to the medial motions of the heel.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. An article of footwear including a forefoot portion, a heel portion opposite the forefoot portion, a midfoot portion disposed between the forefoot portion and the heel portion, and a longitudinal axis extending between a medial side and a lateral side of the article of footwear, the article of footwear comprising:

a sole structure having a ground-engaging surface and a foot side surface opposite the ground-engaging surface, the sole structure having a lateral edge extending along a lateral side of a perimeter of the sole structure, a medial edge extending along a medial side of the perimeter of the sole structure, and a rearward edge extending along a rearmost portion of the perimeter of the sole structure;

an upper connected to the sole structure, the upper including an inner surface facing an interior of the article of footwear; and a heel system having:

a medial heel member having a first medial terminal end and a second medial terminal end disposed opposite the first medial terminal end, wherein the first medial terminal end is attached to the rearward edge, wherein the medial heel member terminates at the first medial terminal end, wherein the second medial terminal end is attached to the medial edge, wherein the medial heel member terminates at the second medial terminal end, wherein a region of the medial heel member that is disposed between the first medial terminal end and the second medial terminal end is spaced apart from the foot side surface; and a lateral heel member having a first lateral terminal end and a second lateral terminal end disposed opposite the first lateral terminal end, wherein the first lateral terminal end is attached to the rearward edge, wherein the lateral heel member terminates at the first lateral terminal end, wherein the second lateral terminal end is attached to the lateral edge, wherein the lateral heel member terminates at the second lateral terminal end, and wherein a region of the lateral heel member that is disposed between the first lateral terminal end and the second lateral terminal end is spaced apart from the foot side surface, wherein the medial heel member is a separate and distinct part from the lateral heel member, and wherein the first medial terminal end is spaced apart from the first lateral terminal end;

wherein the medial heel member extends from the rearward edge of the sole structure to the medial edge of the sole structure, wherein the lateral heel member extends from the rearward edge of the sole structure to the lateral edge of the sole structure, wherein a flat inner surface of the medial heel member faces a flat inner surface of the lateral heel member, and the lateral heel member is a mirror image of the medial heel member;

wherein the sole structure further includes:

a raised rim extending from a perimeter of the foot side surface of the sole structure;

a first medial slot disposed on the raised rim along the medial edge of the sole structure and the first medial terminal end of the medial heel member has a tab that is sized and shaped to fit within the first medial slot; and a second medial slot disposed on the raised rim along the rearward edge of the sole structure and the second medial terminal end of the medial heel member has a tab that is sized and shaped to fit within the second medial slot and wherein the medial heel member extends from the first medial slot to the second medial slot.

2. The article of footwear according to claim 1, wherein the lateral heel member is made of a first material and the medial heel member is made of a second material that has a different rigidity from the first material.

3. The article of footwear according to claim 2, wherein the lateral heel member is more rigid than the medial heel member.

4. The article of footwear according to claim 1, wherein the sole structure further includes:

a first lateral slot disposed on the raised rim along the lateral edge of the sole structure and the first lateral terminal end of the lateral heel member has a tab that is sized and shaped to fit within the first lateral slot; and a second lateral slot disposed on the raised rim along the rearward edge of the sole structure and the second lateral terminal end of the lateral heel member has a tab that is sized and shaped to fit within the second lateral slot and wherein the lateral heel member extends from the first lateral slot to the second lateral slot.

5. The article of footwear according to claim 1, wherein the lateral heel member and the medial heel member are both disposed against the inner surface of the upper.

6. An article of footwear including a forefoot portion, a heel portion opposite the forefoot portion, a midfoot portion disposed between the forefoot portion and the heel portion, and a longitudinal axis extending between a medial side and a lateral side of the article of footwear, the article of footwear comprising:

a sole structure having a ground-engaging surface and a foot side surface opposite the ground-engaging surface, the sole structure having a lateral edge extending along a lateral side of a perimeter of the sole structure, a medial edge extending along a medial side of the perimeter of the sole structure, and a rearward edge extending along a rearmost portion of the perimeter of the sole structure;

an upper connected to the sole structure, the upper including an inner surface facing an interior of the article of footwear; and a heel system having a medial heel member and a lateral heel member, wherein the medial heel member is an elongate arm having a first medial terminal end, a second medial terminal end opposite the first medial terminal end, and a first medial segment extending from the second medial terminal end to a point disposed between the first medial terminal end and the second medial terminal end, wherein the medial heel member terminates at both the first medial terminal end and at the second medial terminal end, wherein the first medial terminal end of the medial heel member is connected to the medial edge of the sole structure, and wherein the second medial terminal end of the medial heel member is connected to the rearward edge of the sole structure, wherein the lateral heel member is an elongate arm having a first lateral terminal end and a second lateral terminal end opposite the first lateral terminal end, and a first lateral segment extending from the second lateral terminal end to a point disposed between the first lateral terminal end and the second lateral terminal end, wherein the lateral heel member terminates at both the first lateral terminal end and at the second lateral terminal end, wherein the first lateral terminal end of the lateral heel member is connected to the lateral edge of the sole structure, and wherein the second lateral terminal end of the lateral heel member is connected to the rearward edge of the sole structure, wherein the first medial segment extends substantially perpendicular to the sole structure and the first lateral segment is substantially parallel to the first medial segment, wherein the first medial segment has an inner surface facing the interior of the upper and the first lateral segment has an inner surface facing the interior of the upper, wherein the medial heel member is a separate and distinct part from the lateral heel member, and wherein the first medial segment is spaced apart from the first lateral segment;

wherein the sole structure has:

a raised rim extending from a perimeter of the foot side surface of the sole structure; and a first medial slot disposed on an inward surface of the raised rim along the medial edge of the sole structure and the first medial terminal end of the medial heel member has a tab that is sized and shaped to fit within the first medial slot.

7. The article of footwear according to claim 6, wherein the sole structure has a second medial slot disposed on an inward surface of the raised rim along the rearward edge of the sole structure and the second medial terminal end of the medial heel member has a tab that is sized and shaped to fit within the second medial slot and wherein the medial heel member extends from the first medial slot to the second medial slot.

8. The article of footwear according to claim 7, wherein the sole structure has a first lateral slot disposed on an inward surface of the raised rim along the lateral edge of the sole structure and the first lateral terminal end of the lateral heel member has a tab that is sized and shaped to fit within the first lateral slot.

9. The article of footwear according to claim 8, wherein the sole structure has a second lateral slot disposed on an inward surface of the raised rim along the rearward edge of the sole structure and the second lateral terminal end of the lateral heel member has a tab that is sized and shaped to fit within the second lateral slot and wherein the lateral heel member extends from the first lateral slot to the second lateral slot.

10. The article of footwear according to claim 9, wherein the lateral heel member has a first rigidity and the medial heel member has a second rigidity that is different from the first rigidity.

11. The article of footwear according to claim 6, wherein the medial heel member and the lateral heel member each have a flat inner surface facing toward the interior of the upper, wherein the lateral heel member and the medial heel member both have an outer surface following the contour of the upper, and wherein the medial heel member and the lateral heel member are designed to together wrap around and cradle the heel region of a wearer.

* * * * *